US005807413A

United States Patent [19]

Wittenbrink et al.

[11] Patent Number: 5,807,413

[45] Date of Patent: Sep. 15, 1998

[54] SYNTHETIC DIESEL FUEL WITH REDUCED PARTICULATE MATTER EMISSIONS

[75] Inventors: Robert Jay Wittenbrink; Richard Frank Bauman; Daniel Francis Ryan, all of Baton Rouge, La.; Paul Joseph Berlowitz, East Windsor, N.J.

[73] Assignee: Exxon Research and Engineering Company, Florham Park, N.J.

[21] Appl. No.: 691,769

[22] Filed: Aug. 2, 1996

[51] Int. Cl.[6] ..... C10L 1/18

[52] U.S. Cl. ..... 44/451; 208/15; 208/27; 585/734

[58] Field of Search ..... 585/734; 44/451; 208/15, 27

[56] References Cited

U.S. PATENT DOCUMENTS

| | | | |
|---|---|---|---|
| 4,304,871 | 12/1981 | Brennan et al. | 518/717 |
| 4,568,663 | 2/1986 | Mauldin | 585/733 |
| 4,923,841 | 5/1990 | Hamner et al. | 502/230 |
| 5,479,775 | 1/1996 | Kraemer et al. | 60/274 |
| 5,506,272 | 4/1996 | Benham et al. | 518/700 |

FOREIGN PATENT DOCUMENTS

| | | | |
|---|---|---|---|
| WO 9420593 | 9/1994 | WIPO | C10L 1/22 |

*Primary Examiner*—Margaret Medley
*Attorney, Agent, or Firm*—Jay Simon

[57] ABSTRACT

A diesel engine fuel is produced from Fischer-Tropsch wax by separating a light density fraction, e.g., $C_5$–$C_{15}$, preferably $C_7$–$C_{14}$ cut having at least 80+ wt % n-paraffins, no more than 5000 ppm alcohols as oxygen, less than 10 wt % olefins, twice aromatics and very low sulfur and nitrogen.

16 Claims, 2 Drawing Sheets

SYNTHETIC DIESEL FUEL WITH REDUCED PARTICULATE MATTER EMISSIONS

FIELD OF THE INVENTION

This invention relates to a transportation fuel and to a method of making that fuel. More particularly, this invention relates to a fuel, useful in diesel engines, and having surprisingly low particulate emissions characteristics.

BACKGROUND OF THE INVENTION

The potential impact of a fuel on diesel emissions has been recognized by state and federal regulatory agencies, and fuel specifications have now become a part of emissions control legislation. Studies both in the U.S. and in Europe have concluded that particulate emissions are generally a function of fuel sulfur content, aromatics content and cetane number. Consequently, the U.S. Environmental Protection Agency has set a limit on diesel fuel sulfur content of 0.05 wt % as well as a minimum cetane number of 40. Additionally, the state of California has set a 10 vol % maximum on aromatics content. Also, alternative fuels are beginning to play more of a role for low emissions vehicles. Thus, the search for efficient, clean burning fuels, particularly with low particulate emissions remains ongoing.

SUMMARY OF THE INVENTION

In accordance with this invention a fuel useful in diesel engines, derived from the Fischer-Tropsch process, preferably a non-shifting process, when carefully tailored, can result in surprisingly low particulate emissions when combusted in diesel engines. The fuel may be characterized as containing substantially normal paraffins, that is, 80+% n-paraffins, preferably 85+% n-paraffins, more preferably 90+% n-paraffins, and still more preferably 98+% n-paraffins. The initial boiling point of the fuel may range from about 90° F. (32° C.) to about 215° F. (101° C.) and the 90% off (in a standard 15/5 distillation test) may range from about 480° F. (249° C.) to about 600° F. (315° C.). Preferably, however, the initial boiling point ranges from about 180° F. to about 200° F. (82° C. to 93° C.) and the 90% off ranges from about 480° F. to about 520° F. (249° C. to 271° C.). The carbon number range of the fuel is from $C_5$–$C_{25}$, preferably predominantly $C_{5-15}$ more preferably 90+% $C_5$–$C_{15}$, and more preferably predominantly $C_7$–$C_{14}$ and still more preferably 90+% $C_7$–$C_{14}$. The fuel contains small amounts of alcohols, e.g., no more than about 5000 wppm as oxygen, preferably 500–5000 wppm as oxygen; small amounts of olefins, e.g., less than 10 wt. % olefins, preferably less than 5 wt. % olefins, more preferably less than 2 wt. % olefins; trace amounts of aromatics, e.g., less than about 0.05 wt %, and nil sulfur, e.g., less than about 0.001 wt. % S, and nil nitrogen, e.g., less than about 0.001 wt. % N. The fuel material has a cetane number of at least 60, preferably at least about 65, more preferably at least about 70, and still more preferably at least about 72. This material has good lubricity, i.e., better than a hydrotreated fuel of like carbon number range, as measured by the BOCLE test, and oxidative stability. The material used as fuel is produced by recovering at least a portion of the cold separator liquids produced by the Fischer-Tropsch hydrocarbon synthesis, and utilized without further treatment, although additives may be included and the material may also be used, because of its very high cetane number, as diesel fuel blending stock.

DESCRIPTION OF PREFERRED EMBODIMENTS

Figure 1:
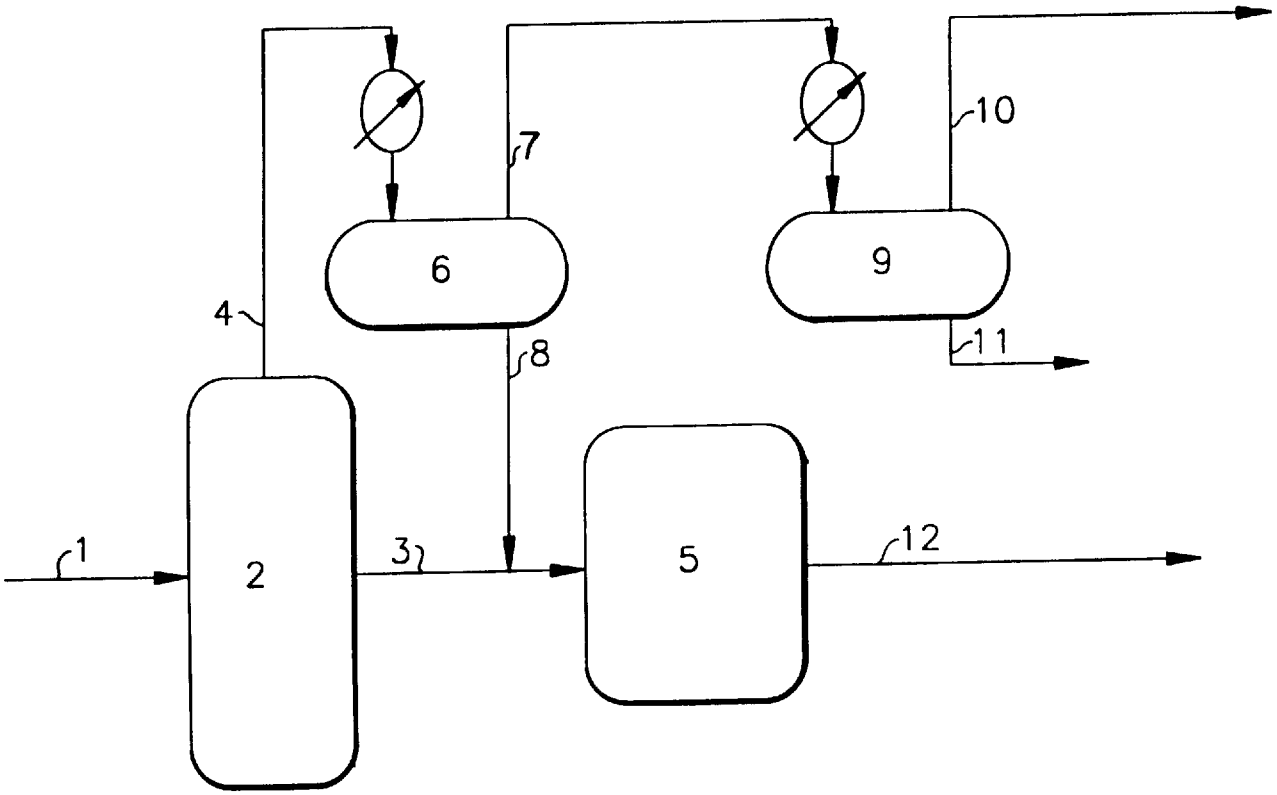
FIG. 1 shows a simplified processing scheme for obtaining the fuel of this invention.

The fuel of this invention is derived from the Fischer-Tropsch process. In this process, and referring now to FIG. 1, synthesis gas, hydrogen and carbon monoxide, in an appropriate ratio, contained in line 1 is fed to Fischer-Tropsch reactor 2, preferably a slurry reactor and product is recovered in lines 3 and 4, the nominally 700° F.+ and 700° F.– fractions, respectively. The lighter fraction goes through hot separator 6 and a nominal 500°–700° F. fraction (the hot separator liquid) is recovered in line 8, while a nominal 500° F.– fraction is recovered in line 7. The 500° F.– fraction goes through cold separator 9 from which $C_4$- gases are recovered in line 10. The nominal $C_5$-500° F. fraction is recovered in line 11, and it is from this fraction that the fuel of this invention is recovered, by further fractionation to the extent desired for achieving the desired carbon number range, that is, a lighter diesel fuel.

The hot separator 500°–700° F. fraction in line 8 may be combined with the 700° F.+ fraction in line 3 and further processed, for example, by hydroisomerization in reactors. The treatment of Fischer-Tropsch liquids is well known in the literature and a variety of products can be obtained therefrom.

In a preferred embodiment of this invention, the hydrocarbon emissions from the combustion of the fuel of this invention are greater than the base case, i.e., the average low sulfur reference diesel fuel, and may be used as a co-reductant in a catalytic reactor for $NO_x$ reduction. Co-reduction is known in the literature; see for example, U.S. Pat. No. 5,479,775. See, also, SAE papers 950154, 950747 and 952495.

The preferred Fischer-Tropsch process is one that utilizes a Group VIII metal as an active catalytic component, e.g., cobalt, ruthenium, nickel, iron, preferably ruthenium, cobalt or iron. More preferably, a non-shifting (that is, little or no water gas shift capability) catalyst is employed, such as cobalt or ruthenium or mixtures thereof, preferably cobalt, and more preferably a promoted cobalt, the promoter being zirconium or rhenium, preferably rhenium. Such catalysts are well known and a preferred catalyst is described in U.S. Pat. No. 4,568,663 as well as European Patent 0 266 898.

The products of the Fischer-Tropsch process are primarily paraffinic hydrocarbons. Ruthenium produces paraffins primarily boiling in the distillate range, i.e., $C_{10}$–$C_{20}$; while cobalt catalysts generally produce heavier hydrocarbons, e.g., $C_{20}$+, and cobalt is a preferred Fischer-Tropsch catalytic metal. Nevertheless, both cobalt and ruthenium produce a wide range of liquid products, e.g., $C_5$–$C_{50}$.

By virtue of using the Fischer-Tropsch process, the recovered distillate has essentially nil sulfur and nitrogen. These hereto-atom compounds are poisons for Fischer-Tropsch catalysts and are removed from the synthesis gas that is the feed for the Fischer-Tropsch process. (Sulfur and nitrogen containing compounds are, in any event, in exceedingly low concentrations in synthesis gas.) Further, the process does not make aromatics, or as usually operated, virtually no aromatics are produced. Some olefins are produced since one of the proposed pathways for the production of paraffins is through an olefinic intermediate. Nevertheless, olefin concentration is usually relatively low.

Non-shifting Fischer-Tropsch reactions are well known to those skilled in the art and may be characterized by conditions that minimize the formation of $CO_2$ byproducts. These conditions can be achieved by a variety of methods, including one or more of the following: operating at relatively low CO partial pressures, that is, operating at hydrogen to CO ratios of at least about 1.7/1, preferably about 1.7/1 to about 2.5/1, more preferably at least about 1.9/1, and in the range 1.9/1 to about 2.3/1, all with an alpha of at least about 0.88, preferably at least about 0.91; temperatures of about 175°–240° C., preferably 180°–220° C.; using catalysts comprising cobalt or ruthenium as the primary Fischer-Tropsch catalysis agent.

The following examples will serve to illustrate, but not limit this invention.

EXAMPLE 1

A mixture of hydrogen and carbon monoxide synthesis gas ($H_2$:CO 2.11–2.16) was converted to heavy paraffins in a slurry Fischer-Tropsch reactor. A titania supported cobalt/rhenium catalyst was utilized for the Fischer-Tropsch reaction. The reaction was conducted at 422°–428° F., 287–289 psig, and the feed was introduced at a linear velocity of 12 to 17.5 cm/sec. The kinetic alpha of the Fischer-Tropsch product was 0.92. The paraffinic Fischer-Tropsch product was isolated in three nominally different boiling streams; separated by utilizing a rough flash. The three boiling fractions which were obtained were: 1) $C_5$ to about 500° F., i.e., cold separator liquid; 2) about 500° to about 700° F., i.e., hot separator liquid; and 3) a 700° F.+ boiling fraction, i.e., reactor wax.

EXAMPLE 2

The F-T reactor wax which was produced in example 1 was then converted to lower boiling materials, i.e., diesel fuel, via mild hydrocracking/hydroisomerization. The boiling point distribution for the F-T reactor wax and hydroisomerized product are given in Table 1. During the hydrocracking/hydroisomerization step the F-T wax was reacted with hydrogen over a dual functional catalyst of cobalt (CoO, 3.2 wt %) and molybdenum ($MoO_3$, 15.2 wt %) on a silica-alumina cogel acidic support, 15.5 wt % of which is $SiO_2$. The catalyst has a surface area of 266 $m^2/g$ and a pore volume ($P.V._{H2O}$) of 0.64 mL/g. The conditions for the reaction are listed in Table 2 and were sufficient to provide approximately 50% 700° F.+ conversion where 700° F.+ conversion is defined as:

$$700° \text{ F.+Conv.}=[1-(\text{wt \% } 700° \text{ F.+ in product})/(\text{wt \% } 700° \text{ F.+ in feed})]\times 100$$

TABLE 1

Boiling Point Distribution of F-T Reactor Wax and Hydroisomerized Product

| | F-T Reactor Wax | Hydroisomerized Product |
|---|---|---|
| IBP–320° F. | 0.0 | 8.27 |
| 320–700° F. | 29.1 | 58.57 |
| 700° F.+ | 70.9 | 33.16 |

TABLE 2

Hydroisomerization Reaction Conditions

| | |
|---|---|
| Temperature, °F. (°C.) | 690 (365) |
| $H_2$ Pressure, psig (pure) | 725 |
| $H_2$ Treat Gas Rate, SCF/B | 2500 |
| LHSV, v/v/h | 0.6–0.7 |
| Target 700° F. + Conversion, wt % | 50 |

EXAMPLE 3

The 320°–700° F. boiling range diesel fuel of Example 2 and the raw unhydrotreated cold separator liquid of Example 1 were then evaluated to determine the effect of diesel fuels on emissions from a modern, heavy-duty diesel engine. For comparison, the F-T fuels were compared with an average U.S. low sulfur diesel fuel (2-D) and with a CARB certified California diesel fuel (CR). Detailed properties of the four fuels are shown in Table 3. The fuels were evaluated in a CARB-approved "test bench", identified as a prototype 1991 Detroit Diesel Corporation Series 60. The important characteristics of the engine are given in Table 4. The engine, as installed in a transient-capable test cell, had a nominal rated power of 330 hp at 1800 rpm, and was designed to use an air-to-air intercooler; however, for dynamometer test work, a test cell intercooler with a water-to-air heat exchanger was used. No auxiliary engine cooling was required.

TABLE 3

Diesel Fuel Analyses

| Item | ASTM Method | 2-D Reference Fuel | CR California Reference Fuel (A) | F-T Diesel Fuel (C) (Example 2) | F-T Cold Separator Fuel (B) (Example 1) |
|---|---|---|---|---|---|
| Cetane Number | D613 | 45.5 | 50.2 | 74.0 | >74.0 |
| Cetane Index | D976 | 47.5 | 46.7 | 77.2 | 63.7 |
| Distillation Range | D86 | | | | |
| IBP, °F. | | 376 | 410 | 382 | 159 |
| 10% Point, °F. | | 438 | 446 | 448 | 236 |
| 50% Point, °F. | | 501 | 488 | 546 | 332 |
| 90% Point, °F. | | 587 | 556 | 620 | 428 |
| EP, °F. | | 651 | 652 | 640 | 488 |
| °API Gravity | D287 | 36.0 | 36.6 | 51.2 | 62.0 |
| Total Sulfur, % | D2622 | 0.033 | 0.0345 | 0.000 | 0.000 |
| Hydrocarbon Composition: | D1319 | | | | |
| Aromatic, vol. % | | 31.9 | 8.7 | 0.26[a] | 0.01[a] |
| Paraffins | | 68.1 | 91.3 | 99.74 | 99.99 |
| Naphthenes, Olefins | | | | 0 | |
| Flashpoint, °F. | D93 | 157 | 180 | 140 | <100 |
| Viscosity, cSt | D455 | 2.63 | 2.79 | 2.66 | 0.87 |

[a]For greater accuracy SFC analysis was used as opposed D1319.

TABLE 4

Characteristics of Prototype 1991 DDC Series 60 Heavy Duty Engine

| | |
|---|---|
| Engine Configuration and Displacement | 6-Cylinder, 11.1 L, 130 mm Bore × 130 mm Stroke |
| Aspiration | Turbocharged, Aftercooled (Air-to-Air) |
| Emission Controls | Electronic Management of Fuel Injection and Timing (DDEC-II) |

TABLE 4-continued

| Characteristics of Prototype 1991 DDC Series 60 Heavy Duty Engine | |
|---|---|
| Rated Power | 330 hp at 1800 rpm with 108 lb/hr Fuel |
| Peak Torque | 1270 lb-ft at 1200 rpm with 93 lb/hr Fuel |
| Injection | Direct Injection, Electronically Controlled Unit Injectors |
| Maximum Restrictions | |
| Exhaust | 2.9 in. Hg at Rated Conditions |
| Intake | 20 in. $H_2O$ at Rated Conditions |
| Low Idle Speed | 600 rpm |

Regulated emissions were measured during hot-start transient cycles. Sampling techniques were based on transient emission test procedures specified by the EPA in CPR 40, Part 86, Subpart N for emissions regulatory purposes. Emissions of hydrocarbon (HC), carbon monoxide (CO), nitrous oxide ($NO_x$), and particulate matter (PM) were measured. The results of the run are summarized in Table 5. The data are represented as the percent difference relative to the U.S. low sulfur diesel fuel, i.e., fuel 2-D. As expected, the F-T fuel (C) produced significantly lower emissions relative to both the average low sulfur diesel fuel (2-D) and the California reference fuel (CR). The low flash point F-T diesel fuel of this invention (B) produced higher HC emissions, presumably due to the high volatility of this fuel. However, the PM emissions for this fuel were unexpectedly low with over a 40% reduction compared with the 2-D fuel. This result is unexpected based on the fuel consumption. The engine was not manipulated in any way to run on the low flash point fuel. Slight modifications/optimizations to the engine may decrease emissions even further. The high HC emissions from a nil sulfur fuel is a prime candidate for exhaust gas after-treatment, e.g., the HC could be used in conjunction with a Lean-$NO_x$ catalyst wherein the HC acts as the reductant to reduce $NO_x$ emissions.

TABLE 5

Hot Start Transient Emissions Using CARB Protocol

| | Hot Start Transient Emissions, g/hp-hr | | | |
|---|---|---|---|---|
| | HC | CO | $NO_x$ | PM |
| Overall Mean of Average US Diesel Fuel, 2-D | 0.6142 | 1.9483 | 4.2318 | 0.1815 |
| Std. Dev. | 0.0187 | 0.0333 | 0.0201 | 0.0010 |
| Coeff. of Var., % | 3.1 | 1.7 | 0.5 | 0.6 |
| Overall Mean of California Diesel Fuel, CR | 0.4780 | 1.6453 | 4.0477 | 0.1637 |
| Std. Dev. | 0.0193 | 0.0215 | 0.0366 | 0.0021 |
| Coeff. of Var., % | 4.0 | 1.3 | 0.9 | 1.3 |
| Overall Mean of F-T Cold Separator Liquid, example 1 | 0.7080 | 1.1840 | 4.0603 | 0.0943 |
| Std. Dev. | 0.0053 | 0.0131 | 0.0110 | 0.0023 |
| Coeff. of Var., % | 4.0 | 1.3 | 0.3 | 2.4 |
| Overall Mean of F-T Diesel Fuel, example 2 | 0.3608 | 1.0798 | 3.8455 | 0.1233 |
| Std. Dev. | 0.0316 | 0.0223 | 0.0101 | 0.0017 |
| Coeff. of Var., % | 8.8 | 2.1 | 0.3 | 1.4 |

Figure 2:
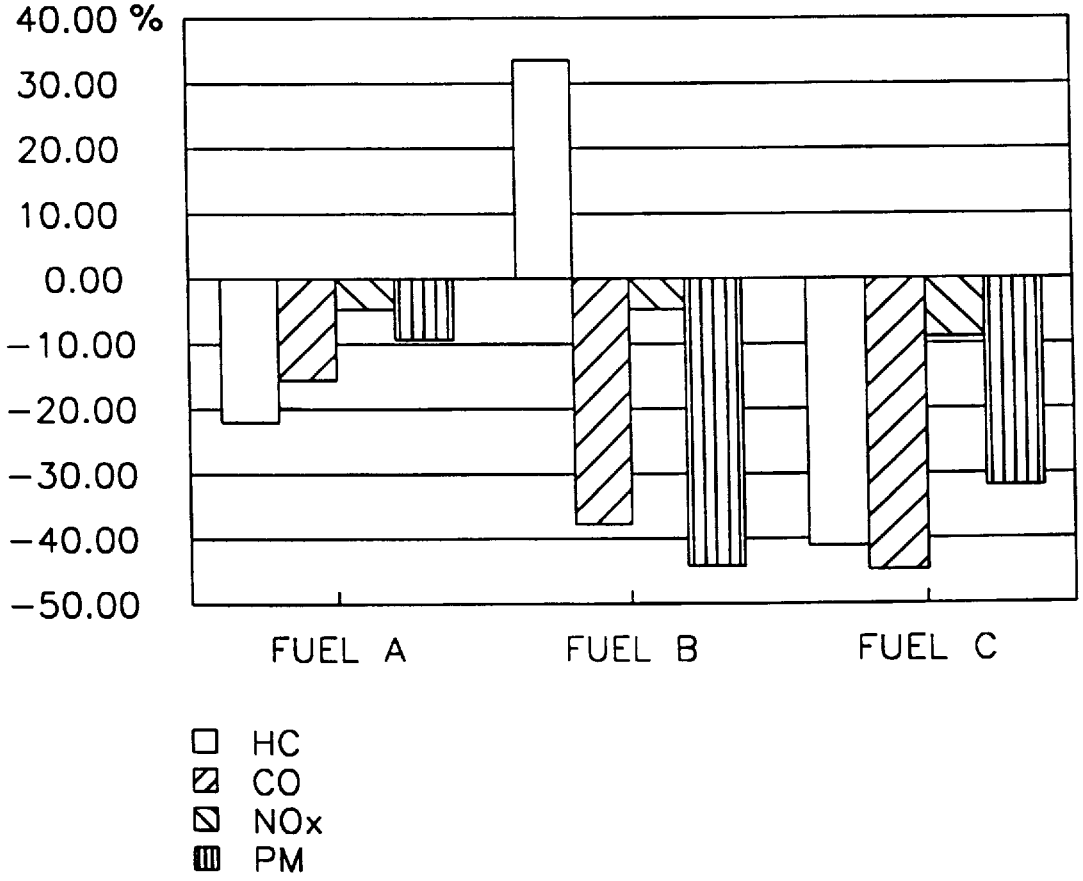
FIG. 2 shows a comparison of three different diesel fuels, using as the baseline an average U.S. low sulfur diesel fuel (2-D reference fuel); fuel A being a California reference fuel (CARB certified); fuel B being the fuel of this invention, and fuel C being a full range Fischer-Tropsch diesel fuel, a $C_5$–$C_{25}$ material with ≧80% wt. % paraffins, boiling in the range 250°–700° F. The ordinate is emissions relative to the average U.S. diesel fuel expressed as a percent (%).

The results in Table 5 can be compared with the auto-oil studies run in the U.S. and Europe on diesel emissions from heavy duty vehicles. In Europe the EPEFE study on heavy duty diesels, reported in SAE paper 961074, SAE 1996, shows in Tables 3 through 6, incorporated hereinby reference, the effect of changing fuel variables on particulate emissions (PM). The results show that the variables density, cetane, number, and T95 (95% off boiling point) do not have statistically significant effects on PM emissions. These three parameters are significantly different for the F-T Diesel fuel of example 2 and the F-T cold separator liquids. Only the effect of changing polyaromatic level (Table 4 of SAE 961074) shows a statistically significant effect; however, this variable does not differ between the two F-T fuels (both have <0.01% polyaromatics), so no difference in performance can be predicted. In contrast, the same study does predict that hydrocarbon emissions will increase in the F-T cold separator liquids vs. the F-T diesel fuel just as has been observed in the results of Table 5 and FIG. 2.

Additionally, several studies investigating the effect of diesel fuel properties on heavy duty engine emissions in the U.S. were performed, the most significant being studies reported in SAE papers 941020, 950250 and 950251 and conducted on behalf of the Department of Emissions Research (DER), Automotive Products and Emissions research division of Southwest Research Institute, Dallas, Tex. for the Coordinating Research Council—Air Pollution Research Advisory Committee (CRC-APRAC), under the guidance of the CRC VEIO Project Group.

Although the studies in the three SAE papers did not deliberately vary either the density or the distillation profile of the fuels, these properties, of necessity, were varied as a natural consequence of changing the fuel cetane number and aromatic content. The results of these studies were that particulate matter (PM) emissions were primarily affected by the cetane number, sulfur content, oxygen content and aromatic content of the fuels. However, neither fuel density nor distillation profile had any effect on particulate matter (PM) emissions in these studies.

The citations of the several SAE papers referenced herein are:

T. L. Ullman, K. B. Spreen, and R. L. Mason, "*Effects of Cetane Number, Cetane Improver, Aromatics, and Oxygenates on* 1994 *Heavy-Duty Diesel Engine Emissions*", SAE Paper 941020.

K. B. Spreen, T. L. Ullman, and R. L. Mason, "*Effects of Cetane Number, Aromatics, and Oxygenates on Emissions From a* 1994 *Heavy-Duty Diesel Engine With Exhaust Catalyst*", SAE Paper 950250.

T. L. Ullman, K. B. Spreen, R. L. Mason, "*Effects of Cetane Number on Emissions From a Prototype* 1998 *Heavy-Duty Diesel Engine*", SAE Paper 950251.

J. S. Feely, M. Deebva, R. J. Farrauto, "*Abatement of NOx from Diesel Engines: Status & Technical Challenges*", SAE Paper 950747.

J. Leyer, E. S. Lox, W. Strehleu, "*Design Aspects of Lean NOx Catalysts for Gasoline & Diesel Applications*", SAE Paper 952495.

M. Kawanami, M. Moriuchi, I. Leyer, E. S. Lox, and D. Psaras, "*Advanced Catalyst Studies of Diesel NOx Reduction for On-Highway Trucks*", SAE Paper 950154.

What is claimed is:

1. A fuel useful for combustion in fuel diesel engines comprising:

predominantly $C_5$–$C_{15}$ paraffin hydrocarbons of which at least about 80 wt % are n-paraffins, no more than 5000 wppm alcohols as oxygen ≦10 wt % olefins ≦0.05 wt % aromatics <0.001 wt % S <0.001 wt % N cetane number ≧60.

2. The fuel of claim 1 wherein the initial boiling point of the fuel ranges from about 90°–215° F. and the 90% off boiling point ranges from about 480° F.–600° F.

3. The fuel of claim 1 wherein the paraffin hydrocarbons are at least 90 wt % n-paraffins.

4. The fuel of claim 1 wherein the alcohol content ranges 500–5000 wppm as oxygen.

5. The fuel of claim 1 wherein the olefin content is ≦5 wt %.

6. The fuel of claim 5 wherein the olefin content is ≦2 wt %.

7. The fuel of claim 5 wherein the cetane number is greater than 65.

8. The fuel of claim 7 derived from a Fischer-Tropsch process utilizing a Group VIII metal catalyst.

9. The fuel of claim 8 wherein the Fischer-Tropsch process is essentially non-shifting wherein the Fischer-Tropsch catalyst comprises cobalt or ruthenium or mixtures thereof.

10. The fuel of claim 9 wherein the Fischer-Tropsch catalyst comprises cobalt.

11. The fuel of claim 5 wherein the carbon number range is predominantly $C_7$–$C_{14}$.

12. The fuel of claim 10 wherein the initial boiling point is about 180°–200° F. and the 90% boiling point ranges from about 480°–520° F.

13. A process for producing a diesel engine fuel comprising paraffinic hydrocarbons having low particulate emissions after combustion which comprises reacting, under Fischer-Tropsch reaction conditions, hydrogen and carbon monoxide synthesis gases in the presence of a Fischer-Tropsch Group VIII metal catalyst, recovering from the reaction a light fraction product nominally comprising a 700° F.-material, and recovering from the light product a fuel predominantly comprising $C_5$–$C_{15}$ paraffin hydrocarbons as described in claim 1.

14. The process of claim 13 wherein the Fischer-Tropsch catalyst comprises cobalt.

15. The process of claim 13 wherein the Fischer-Tropsch catalyst is non-shifting and comprises cobalt or ruthenium or mixtures thereof.

16. The process of claim 14 wherein a nominal $C_5$-500° F. fraction is further recovered from the light product, and from which the fuel of claim 1 is recovered.

* * * * *